United States Patent [19]

Hamada

[11] 4,338,674

[45] Jul. 6, 1982

[54] DIGITAL WAVEFORM GENERATING APPARATUS

[75] Inventor: Osamu Hamada, Kanagawa, Japan

[73] Assignee: Sony Corporation, Tokyo, Japan

[21] Appl. No.: 136,296

[22] Filed: Apr. 1, 1980

[30] Foreign Application Priority Data

Apr. 5, 1979 [JP] Japan ..... 54-41324

[51] Int. Cl.[3] ..... G10H 1/00; G10H 1/06

[52] U.S. Cl. ..... 364/718; 84/1.01; 84/1.19

[58] Field of Search ..... 364/715, 718, 571, 487, 364/721; 84/1.01, 1.03, 1.19

[56] References Cited

U.S. PATENT DOCUMENTS

| | | | |
|---|---|---|---|
| 3,633,017 | 1/1972 | Crooke | 364/718 |
| 3,743,755 | 7/1973 | Watson | 84/1.01 |
| 3,809,789 | 5/1974 | Deutsch | 84/1.19 |
| 3,979,989 | 9/1976 | Tomisawa et al. | 84/1.01 |
| 4,026,179 | 5/1977 | Futamase | 84/1.01 |
| 4,131,049 | 12/1978 | Okumura et al. | 84/1.01 |
| 4,141,268 | 2/1979 | Kugisawa | 84/1.03 |
| 4,176,577 | 12/1979 | Yamada et al. | 84/1.01 |
| 4,183,275 | 1/1980 | Niimi et al. | 84/1.01 |
| 4,213,366 | 7/1980 | Niimi et al. | 84/1.01 |
| 4,223,582 | 9/1980 | Kato et al. | 84/1.01 |

*Primary Examiner*—Mark E. Nusbaum
*Assistant Examiner*—Gary Chin
*Attorney, Agent, or Firm*—Lewis H. Eslinger; Alvin Sinderbrand

[57] ABSTRACT

A digital waveform generating apparatus includes a key assignor selecting a frequency of a signal to be generated, a number-setting circuit for generating a first data word corresponding to the selected frequency, a first memory for storing said first data word, a second memory for storing a second data word, an accumulator for accumulating the first data word onto the second data word stored in the second memory, so that the second data word stored in the second memory after accumulating represents the sum of the second data word immediately prior thereto added with said first data word, a waveform memory, preferably an ROM, for storing predetermined waveform data and for generating a waveform data output signal, and a control circuit for controlling such accumulating and progressively addressing the waveform memory in accordance with the stored second data word at the time of a timing signal. Preferably, the number-setting circuit generates a plurality of the first data words corresponding to at least one corresponding frequency, the first and second memories have a plurality of channels storing the first data word and the second data words to be added with the first data words, and the control circuit operates in a time-sharing fashion. To avoid folded errors in the output signal, the waveform memory can include a plurality of data banks each storing waveform data corresponding to a predetermined portion of the frequency range of the apparatus, and the control circuit operates to select an appropriate data bank corresponding to the selected frequency.

5 Claims, 21 Drawing Figures

FIG. 3
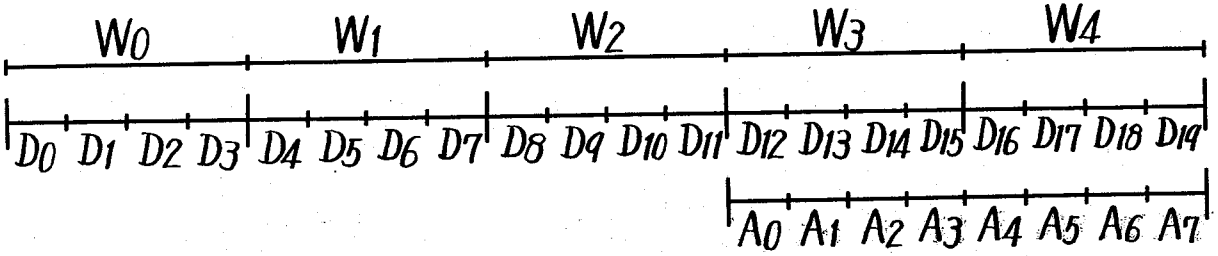
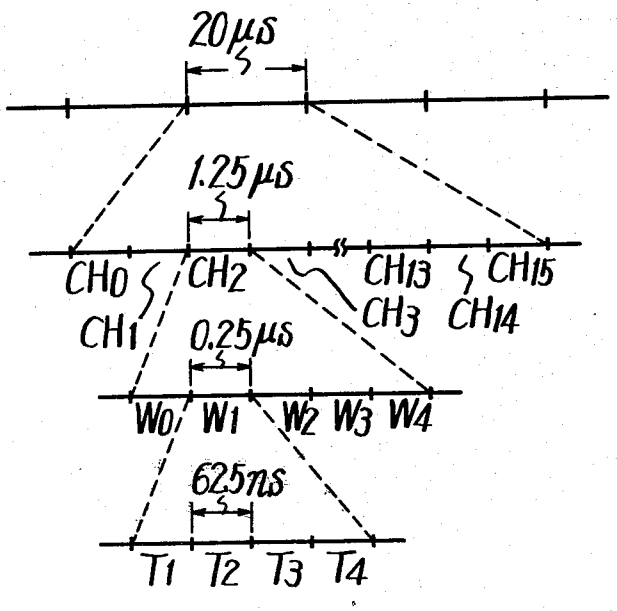
FIG. 4A
FIG. 4B
FIG. 4C
FIG. 4D

CH0
W0
W1
W2
W3
W4

00 01 02 03 04 05 06 07 08 09

T1 T2 T3 T4

DIGITAL WAVEFORM GENERATING APPARATUS

BACKGROUND OF THE INVENTION

1. Field of the Invention

The present invention relates generally to digital waveform generating apparatus, and is directed more particularly to a digital waveform generating apparatus suitable for use, for example, to generate audio waveforms in an electronic musical instrument.

2. Description of the Prior Art

In a prior art analog electronic musical instrument, for example, a music synthesizer, various waveforms, such as a sinusoidal, triangular, saw-tooth, or other waveform are generated by means of one or more voltage controlled oscillators (VCOs). In the prior art, however, since the audio signals are generated using analog techniques, various problems arise in the accuracy of frequency, stability, and freedom of selecting generated waveforms.

Recently, in order to avoid the above-mentioned problems, attempts have been made to generate audio signals digitally.

The advantages of a system that digitally processes an audio signal to generate a desired waveform are that a rather high stability of frequency is obtained, any arbitrary desired waveform can be easily generated and, in addition, time division superimposing of various audio signals is possible, whereas such time division superimposing is difficult in an analog system. Further, is is simple to control a digital system and also the digital system can readily memorize a generated sound. Owing to the last-mentioned advantage of the digital system, it is possible to generate a sound that is remarkably similar to a natural sound by using a number of digital sound sources.

In general, a system to generate a waveform by digital techniques includes an ROM (read only memory), RAM (random access memory) or shift register to store, as digital data a desired waveform or such a value that is obtained by sampling one period or a predetermined number of periods of a fundamental waveform, and the stored digital data is used to generate a desired waveform by synthesizing, at a sampling frequency higher at least twice as high as the highest frequency contained in the fundamental waveform. Basically, two types of such digital systems may be considered. A first type of digital waveform generating system is a so-called variable clock system, in which the stored waveform data are sequentially read out by a clock whose speed is varied in correspondence with a selected musical scale frequency to produce a musical sound with that musical scale frequency. A second type of system is a so-called fixed clock system, in which an address signal varies the separation between successive addresses of the waveform data to an amount that corresponds with the musical scale frequency applied to the ROM or RAM to produce a musical sound with that musical scale frequency. In the case of the variable clock system, when such system is constructed to be able to sequentially vary the frequency, it is rather difficult for the system to have good frequency stability.

OBJECTS AND SUMMARY OF THE INVENTION

Accordingly, an object of the present invention is to provide a novel digital waveform generating apparatus free of the defects encountered in the prior art.

Another object of the invention is to provide a digital waveform generating apparatus of simple construction which can simplify the signal processing sequence.

A further object of the invention is to provide a digital waveform generating apparatus in which data transfer and waveform generation can be easily carried out.

A further object of the invention is to provide a digital waveform generating apparatus in which a plurality of waveforms can be generated simultaneously.

A still further object of the invention is to provide a digital waveform generating apparatus, in which sound sources with various tones can be easily presented.

A yet another object of the invention is to provide a digital waveform generating apparatus in which tone quality can be varied in response to sound range.

A further object of the invention is to provide a digital waveform generating apparatus by which a folded error can be avoided.

According to an aspect of the present invention, a digital waveform generating apparatus for generating a signal of a desired waveform at a selected frequency within a frequency range comprises a number generator for generating a first data word whose digital value corresponds to the selected frequency; a first memory for storing the first data word; a second memory for storing a second data word; an accumulator for accumulating the first data word onto the stored second data word so that the stored second data word, following such accumulating, becomes the sum of the first data word and the second data word immediately prior to the accumulating; a waveform memory for storing a plurality of waveform data words corresponding to said waveform, each of the waveform data words being stored at a predetermined respective address in the waveform memory; a clock providing a timing signal; and a control circuit, responsive to the timing signal for controlling the accumulating and for progressively addressing the waveform memory in accordance with the second data word being stored in the second memory at the time of the timing signal so that the addressed waveform data words are read out therefrom as an output signal. Preferably, the apparatus is adapted for time-sharing operation so that a plurality of frequencies can be selected simultaneously; and the number generator generates a plurality of first data words corresponding to the plurality of selected frequencies. In such case, the first and second memories each have a plurality of respective channels for storing the plurality of second data words to be accumulated with the first data words, and the control circuit, in a time-sharing fashion, both controls the accumulating of each of the plurality of data words and addresses the waveform memory. In order to avoid folded errors in the output signal, the waveform memory includes a plurality of data banks each corresponding to a predetermined portion of the frequency spectrum and each storing a corresponding plurality of waveform data words therein, and the control circuit selects a corresponding one of the data banks, in accordance with the selected frequency, to provide its waveform data words as the output signal. The waveform data words stored in the data banks represent waveforms that have progressively fewer harmonics as the frequency of the corresponding portions of the frequency range increases.

Other objects, features and advantages of the present invention will become apparent from the following description when read in conjunction with the accompanying drawings through which the like reference numerals identify the same elements and parts.

BRIEF DESCRIPTION OF THE DRAWINGS

FIG. 3 is a diagram showing the assignment of respective data words;

FIGS. 4A through 4D are respectively diagrams showing the allocation of respective operation time for achieving time division;

DESCRIPTION OF THE PREFERRED EMBODIMENT

An embodiment of the present invention employs the fixed clock system described above. Thus, the fixed clock system will be now described in greater detail. In this system, one period component of a waveform to be generated, that is, one complete period thereof, is sampled at a predetermined sampling rate, and the respective sampled data are stored in a waveform data ROM as digital values. Each digital value of the sampled data is added with an address number, and the waveform data are read out by varying the address number sequentially. In the fixed clock system, the frequency of a read-out waveform can be varied by varying the changing width of the address number at every constant period.

This changing width of the address number corresponds to the jump between successive ROM addresses for successive occurrences of the fixed clock pulses. In other words, in the fixed clock system, tones of different frequencies are generated by selecting the number of waveform ROM addresses to be skipped between periods of the fixed clock. For example, low frequency tones would require that few addresses be skipped, with the result that the changing width of the ROM address number is kept small, while higher frequency tones would require that the number of addresses to be skipped be rather high, and correspondingly, that the changing width of the address number be high.

As a practical matter, in order to achieve the above, the changing width (corresponding to an adding number n) of the address number is determined in correspondence with the frequency of a desired waveform, i.e., the actuation of a manually pushed key, and then the address number is accumulated onto an initial value of the address number or address number before one period (taken as a number a to be added) at every constant period corresponding to the fixed clock frequency.

Generally, when a waveform with a desired frequency is generated, the following relation is established between the generated frequency F and the above adding number n.

$$F = n \cdot f_c / 2^B \quad (1)$$

where $f_c$ is the fixed sampling clock frequency, B is the data bit number of the adding number n, and $2^B$ is the maximum number of memory addresses.

From the foregoing it should be understood that the added number n identifies the number of ROM addresses to be skipped over at each occurrence of the fixed clock pulse, and such number is generally proportional to the selected frequency. However, the address number a represents the accumulated current address of the ROM, and the value thereof is not relevant to a determination of the selected frequency.

From the equation (1), it becomes apparent that if the fixed sampling clock frequency $f_c$ and the sampled number of waveform data, that is, to total number of memory addresses, is constant, the generated frequency F can be varied by varying the adding number n.

Figure 1:
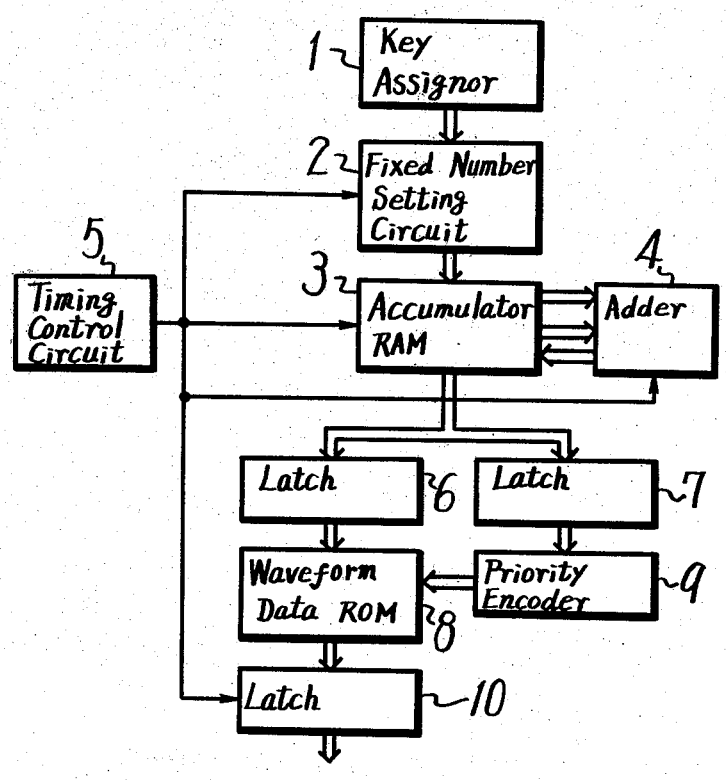
FIG. 1 is a block diagram showing the fundamental construction of one embodiment of the digital waveform generating apparatus according to the present invention.

FIG. 1 shows the fundamental construction of an example of the digital waveform generating apparatus according to the present invention. In FIG. 1, a key assignor 1 is coupled to a key board (not shown). Frequency information corresponding to a signal waveform to be generated, which corresponds to a pushed-down key of the key assignor 1, is derived from the key assignor 1 and then is furnished to a fixed number setting circuit 2 in which the changing width of an address number, i.e., adding number n corresponding to the frequency information, is set in accordance with the above fixed clock system. The adding number n is subjected to an accumulation process in an RAM 3 which serves as an accumulator and in an adding circuit or adder 4 which increases an address number by n at every occurrence of the sampling clock signal. That is, the RAM 3 stores the adding number n from the fixed number setting circuit 2 and also the added number a, which represents the current sum of all previous accumulation operations. The numbers a and n are added in the adder 4, and the numbers thus added are fed back to the RAM 3 to be stored therein as a new number a' (where $a' = a + n$) to be added. The above accumulation process is controlled by a timing signal provided from a timing control circuit 5.

The adder number a and adding number n thus stored in the RAM 3 are supplied to latch circuits 6 and 7, each of which are latched at every one clock period. The added number a, that is, the accumulated address latched from the latch circuit 6 is furnished to a waveform data ROM 8 to designate an address of a waveform data word stored therein.

In order to avoid so-called folded errors, that is, those errors that occur when the frequency component of a waveform to be read out from the waveform data ROM 8 includes a high harmonic component with a frequency higher than one-half the sampling frequency, a plurality of waveform data, which are preliminarily subjected to a band limitation, are prepared and stored in the waveform data ROM 8 which is therefore constructed in the form of a plurality of data banks. To achieve this, the adding number n latched in the latch circuit 7 is furnished to a priority encoder 9 as the frequency information of the waveform. Then, priority encoder 9 provides a signal appropriate to select the data bank which is to be used. This signal is fed to the waveform data ROM 8.

The waveform data thus read out from a predetermined data bank in the waveform data ROM 8 is fed to a latch circuit 10, in the next stage, to be latched therein in a predetermined time period, and thereafter delivered outside therefrom by the timing signal from the timing control circuit 5.

Now, a practical example will be described in which a plurality of different waveforms are simultaneously generated, and a time division process is carried out by the described embodiment of the waveform generating apparatus of the invention, with reference to FIGS. 2, 3 and 4A through 4D.

Firstly, let it be assumed that the sampling clock frequency $f_c$ is 50 $KH_z$, the frequency F of a generated waveform is 0.04768 $H_z$ to 19.99998 $KH_z$ and the adding number n and added number a each are 20 bits of data ($D_0$ to $D_{19}$). Then, it will be understood from the equation (1) that the adding number n can be varied in the range of 1 to 419430.

In the above embodiment of the invention, since the sample number of waveform data for one period stored in the waveform data ROM 8 is 256, the address of the waveform data requires eight bits of data, and since the number of waveform data banks is eight, only the eight most significant bits $D_{12}$ to $D_{19}$ in the numbers n and a, each of which has a length of 20 bits, are used as practical address signals of the waveform data ROM 8. Further, the time division process is carried out so as to provide different waveforms in, at most, 16 channels.

Figure 2:
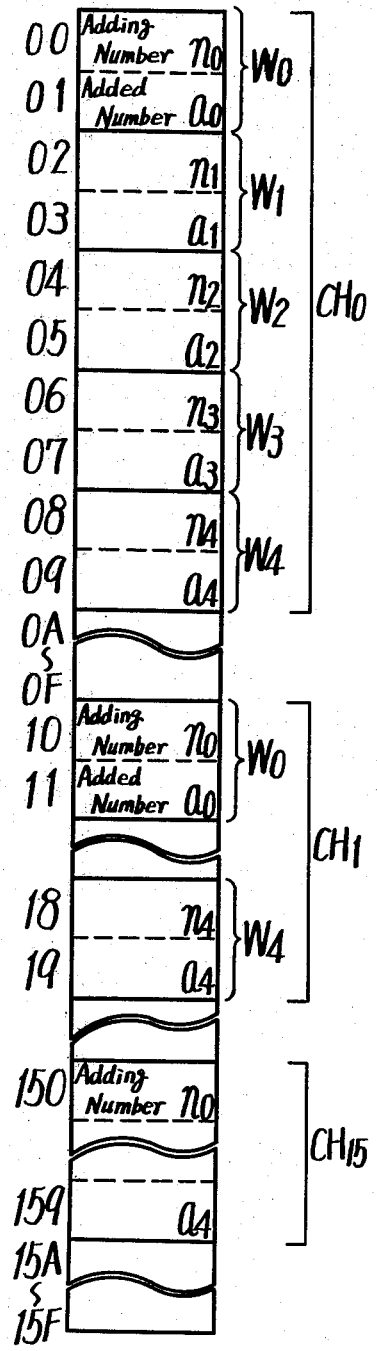
FIG. 2 is a memory map of a RAM which forms a part of the example shown in FIG. 1.

In order to carry out the above process, and as shown in FIGS. 2 and 3, RAM 3 comprises storing regions sufficient for 16 channels, and each channel is divided into two registers for storing the numbers n and a, each of 20 bits $D_0$ to $D_{19}$. However, a practical off-the-shelf RAM is available which has a capacity of 256×4 bits and in such a RAM it is possible to write in or read out information words of four bits in parallel, that is, to read or write all four bits simultaneously and also to store digital information in 256 sets each set consisting of four bits. Accordingly, the memory map of RAM 3 is shown in FIG. 2, in which a plurality of channels, for example, sixteen channels $CH_0$ to $CH_{15}$ are provided and each channel occupies sixteen addresses 00 to 0F (for example, 00 to 09 and 0A to 0F in the first channel $CH_0$). In practice, only the first ten addresses 00 to 09 are used, and each pair of two adjacent addresses is considered as one word; hence the first ten addresses are allocated to five words $W_0$ to $W_4$. In this case, the former address in each word (that is, in each pair of addresses 00, 01 . . . 08, 09) is assigned to store the adding number n and the latter address is assigned to store the added number a. As a result, the numbers n and a, each consisting of 20 bits, are respectively assigned 4 bits by 4 bits from the word $W_0$ to $W_4$ sequentially from the lower 4 bits (adding number $n_0$, added number $a_0$) to the higher 4 bits (adding number $n_4$, added number $a_4$).

To time-division-operation-process these data, operation times shown in FIGS. 4A to 4D are assigned. Each of the items of data for generating audio signals in the sixteen channels $CH_0$ to $CH_{15}$ is processed in turn. That is, if the sampling clock frequency $f_c$ is 50 $KH_z$, its sampling period becomes 20 μs as shown in FIG.4A. In order to time-division-operation-process the sixteen channels $CH_0$ to $CH_{15}$ in one period of 20 μs, the operation time of 1.25 μs is assigned to each channel as shown in FIG. 4B. Further, in each channel, five words $W_0$ to $W_4$ are time-division-processed and the processing time is 0.25 μs per one word, as shown in FIG. 4C. In order to accumulation-process the adding number n, four time slots $T_1$, $T_2$, $T_3$ and $T_4$ (FIG. 4D) are provided in each word, as described in detail below. The time of each time slot is 62.5 ns. Since this time 62.5 ns is the minimum unit period of the data process operation, the system clock frequency must be 8 $MH_z$.

In the RAM 3, for each word, the adding number n is read out in time slot $T_1$, written in time slot $T_2$, and the added number a is read out in time slot $T_3$ and then written in time slot $T_4$.

As described above, according to the present invention, it will be understood that for each one word, the required arithmetic operation time span consists of at least the four time slots $T_1$–$T_4$, so that constant reading-out, constant writing-in, operation register reading-out and operation register writing-in can be easily effected to make the data transfer and operation smooth and simple.

Further, according to this invention, a plurality of channels can be scanned in a predetermined sampling time, with each channel being divided into a plurality of words to make them a suitable bit length, for example, four bits for simplicity in data transfer and operation, and to thereby simplify the construction. Also, the frequency setting data register and operation register are formed on the same RAM 3 to simplify the signal process sequence.

A practical example of the present invention in which the RAM 3 with the above construction is employed will be now described with reference to FIG. 5.

Figure 5:
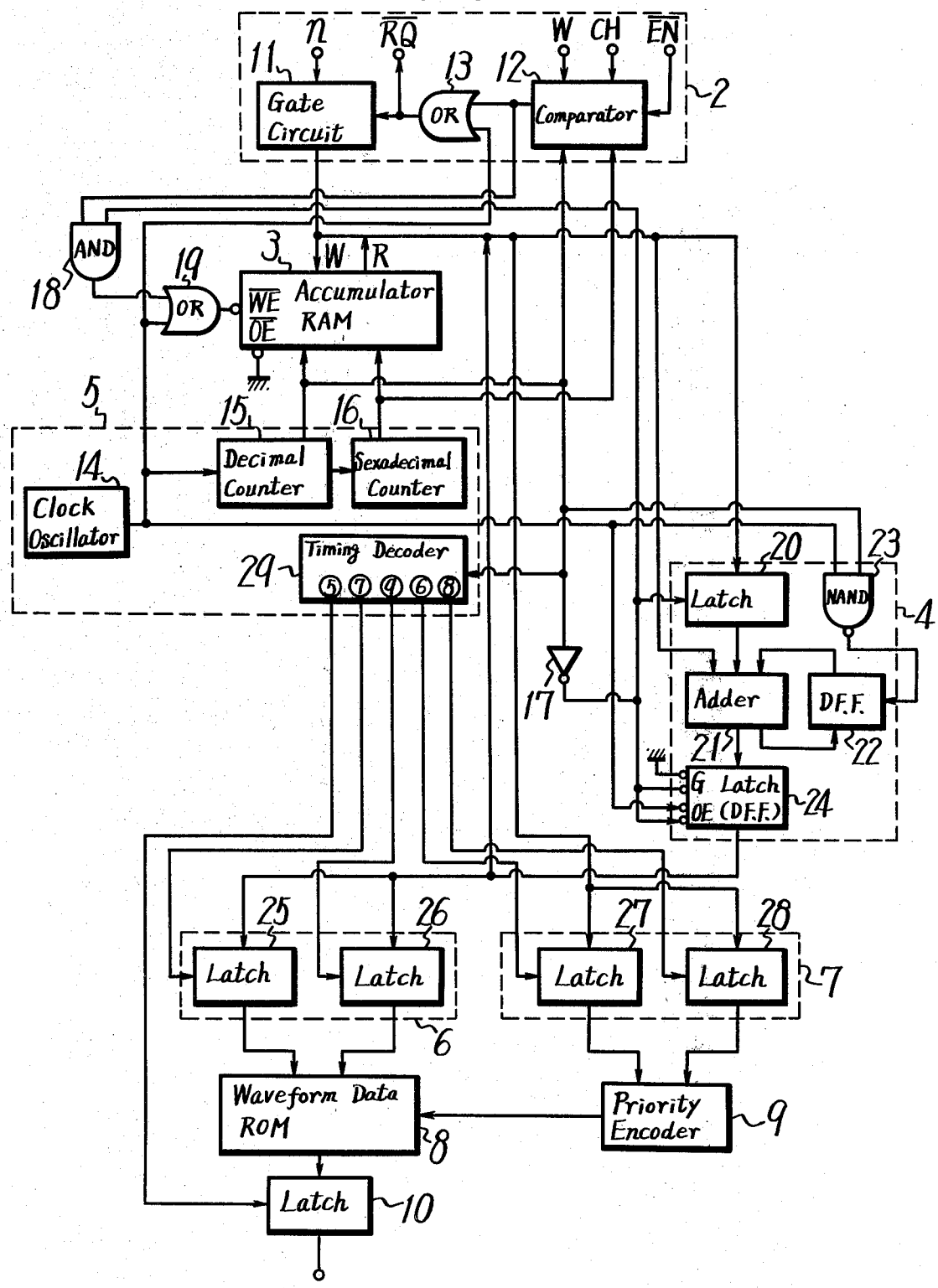
FIG. 5 is a block diagram showing, in detail, the embodiment of the invention shown in FIG. 1.

In the example of FIG. 5, a plurality of frequency information words corresponding to a plurality of keys which are responsive to the pushed keys in the key assignor 1 (which is not shown in FIG. 5) or frequency information words of a plurality of waveforms to be synthesized for a single pushed key are generated, and in the fixed number setting circuit 2, based upon the frequency information words thus generated, a plurality of numbers n are set as four bit data words $n_0$ to $n_4$, and the word addresses $W_0$ to $W_4$ and channel addresses $CH_0$ to $CH_4$ of RAM 3, in which the above data are stored, are respectively set as four bit data words.

The fixed number setting circuit 2 includes a gate circuit 11, to which the set numbers n ($n_0$ to $n_4$) are supplied, a comparator circuit 12, at respective inputs of which the word address $W_0$ to $W_4$ and the channel addresses $CH_0$ to $CH_{15}$ are applied, and an OR circuit 13 through which the output from the comparator circuit 12 is supplied to a gate input of gate circuit 11.

The timing control circuit 5 includes a clock oscillator 14 which generates a system clock signal with a frequency of 8 $MH_z$. This system clock signal is supplied to the OR circuit 13 in the fixed number setting circuit 2 and also to a decimal counter 15 in the timing control circuit 5. This decimal counter 15 counts word addresses. The most significant bit of the number stored in decimal counter 15 is fed to a sexadecimal counter 16 in the timing control circuit which counter 16 counts channel addresses.

The word address signal from the decimal counter 15 and the channel address signal from the sexadecimal counter 16 are respectively applied to the address input terminals of RAM 3 and also to the other input side of comparator circuit 12. The comparator circuit 12 produces a coincidence signal when the word and channel address signals from the counters 15 and 16 coincide with those set in the fixed number setting circuit 2. This coincident signal opens the gate circuit 11, so that the adding number n is written in at a predetermined address in the RAM 3.

The fixed number setting circuit 2, upon simultaneous occurrence of number n, the word address signal and the channel address signal generates an energizing signal $\overline{EN}$ which is provided to trigger the comparator circuit 12, while the coincident signal furnished from the comparator 12 through the OR circuit 13 appears as a response signal $\overline{RQ}$ which is used to set appropriate constants to avoid data errors.

The RAM 3 has a $\overline{WE}$ terminal which enables data write-in when the level thereat is "0" and an $\overline{OE}$ terminal which enables stored data read-out when the level is "0". In the example of FIG. 5, the $\overline{OE}$ terminal is grounded so that the RAM 3 is always enabled for data read-out.

Decimal counter 15, which counts down the coincident output (refer to FIG. 6A) from the comparator 12 and the output (refer to FIG. 6B) from the system clock oscillator 14, provides a least-significant-bit output (refer to FIG. 6C) to an inverter 17 which provides an inverted output (refer to FIG. 6D) to one input of an AND circuit 18 which provides a logic output. The logic output (refer to FIG. 6E) therefrom and the clock signal from the clock oscillator 14 are supplied to an OR circuit 19 whose logic output (refer to FIG. 6F) is fed to the $\overline{WE}$ terminal of RAM 3. As a result, whenever the logic output from the OR circuit 19 is "0", that is, whenever the time slots correspond to $T_2$ and $T_4$, data can be written into RAM 3. Thus, when the address signal from the decimal counter 15 selects the address of the number n in each word (for example, 00, 02, . . . in FIG. 2), the number n is written in the RAM 3 in the time slot $T_2$, and when the address signal selects the address of the number a (for example, 01, 03, . . . in FIG. 2), the number a is written in the RAM 3 in the time slot $T_4$.

The adding circuit 4 includes a latch circuit 20, an adder 21, a flip-flop 22, a NAND circuit 23, and a latch circuit 24. The data corresponding to the number n stored in the RAM 3 and read out therefrom in the time slot $T_1$ are latched in the latch circuit 20 whenever the latch signal shown in FIG. 6D has the level "0", and then these data are fed to the adder 21 when the latch signal has the level "1". At this time, namely in the period corresponding to time slot $T_3$, the data corresponding to number a stored in the RAM 3 are read out and then added to the number n in the adder 21. The adder 21 carries out an adding operation in which, when a carry to the fifth bit is generated in the sum therein, the adder 21 generates a carry signal, which is latched in the flip-flop 22 by the clock pulse, shown in FIG. 6G, that is supplied from the NAND circuit 23, and then the carry signal is fed back to the adder 21 therefrom after one word period. Preferably, a D-type flip-flop is used as carry-saving flip-flop 22.

Figures 6A, 6B, 6C, 6D, 6E, 6F, 6G, 6H, 6I, 6J, 6K, 6L, 6M:
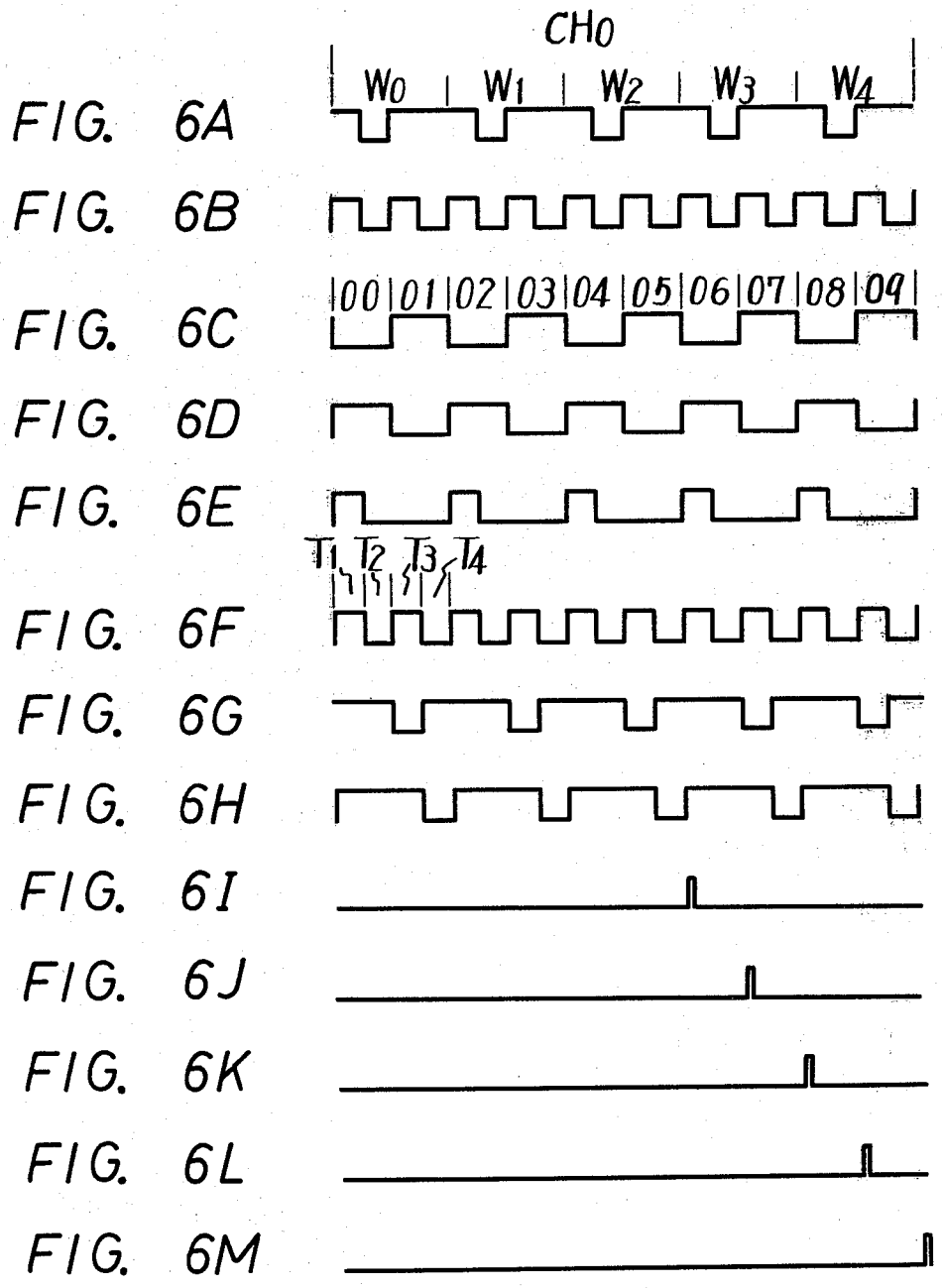
FIGS. 6A through 6M are respectively waveform diagrams showing various timing signals used in the embodiment of the invention shown in FIG. 5.

A new added number a, to which number n is added, is latched by the latch circuit 24 formed of a D-type flip-flop in this embodiment, and is again stored at the address of number a in the RAM 3 at the timing shown in FIG. 6H (i.e., during time slot $T_4$).

As described above, the numbers n and a for the data word in each channel are added or operated on in sequence. In the latter half of this operation process (i.e., the operation process of words $W_3$ and $W_4$), the numbers n and a of each word are fed to RAM 3 and also to latch circuits 25, 26 and 27, 28 which respectively correspond to latch circuits 6 and 7 in FIG. 1. Then, the higher 8 bits ($a_3$, $a_4$) of number a and the higher 8 bits ($n_3$, $n_4$) of number n are latched therein in accordance with the outputs from a timing decoder 29 in the timing control circuit 5. This timing decoder 29 counts the output from the decimal counter 15 and produces at its output terminals ⑤, ⑥, ⑦, ⑧ and ⑨ latch timing signals as respectively shown in FIGS. 6I, 6J, 6K, 6L and 6M. The output signals at the terminals ⑥ and ⑦ are used to latch or take-in the numbers n and a of word $W_3$ in latch circuits 27 and 25, and the output signals at the terminals ⑧ and ⑨ are used to take-in the numbers n and a of word $W_4$ in the latch circuits 28 and 26. The output signal at the terminal ⑤ serves to latch the output from the waveform data ROM 8 at the latch circuit 10.

The added numbers $a_3$ and $a_4$ respectively latched in the latch circuits 25 and 26 are used as address signals to instantaneously select the addresses of waveform data ROM 8 in which there are stored a plurality of waveform data words that have previously been limited in band. As shown in FIG. 3, the address signal uses only the higher eight bits $A_0$ to $A_7$ in the numbers a of the length of 20 bits accumulated in the RAM 3. When the frequency of a generated waveform is determined by the adding number n when the latter is smaller than $2^{12}$ (i.e., a frequency smaller than $$\frac{2^{12} \times 50(KH_z)}{2^{20}} \approx 195\ (H_z)$$

obtained from the equation (1)), the same address is selected repeatedly, and the same data are used for plural samplings.

The adding numbers $n_3$ and $n_4$ respectively latched in the latch circuits 27 and 28 are fed to the priority encoder 9 which then produces a switching signal to change over, at every octave, a plurality of data banks previously set in the waveform data ROM 8 in accordance with the position of the most significant bit which is "1", of the number n supplied from the latch circuits 27 and 28.

In the fixed clock system, if the sampling clock frequency is taken as $f_c$ and the data sample number as N, whenever a frequency higher than $f_c/N$ is generated, a skip is generated in the address selection of the waveform data ROM 8. Furthermore, if a frequency component higher than $f_c/2$ is contained in the waveform data, a folded error may occur in the generated waveform. In order to avoid such a folded error, if the address skip number is taken as x, the generated frequency $F_x$ must be calculated as $F_x = x \cdot f_c/N$. Further, if the order of higher harmonics contained in the waveform data is taken as m, the maximum frequency $F_{max}$ can be expresed as $$F_{max} = m \cdot F_x, \text{ where } m = N/2x$$

Thus, it is sufficient that the higher harmonics should be limited such that the generated waveform does not contain a frequency higher than N/2x.

Therefore, according to the present invention, a plurality of data banks, each subjected to a predetermined band limitation, are arranged in the ROM 8 and are selected by the output from the priority encoder 9.

The frequency range and the order of higher harmonics contained therein for each data bank may be set in the illustrated example as shown in the following table.

TABLE

| Position of most significant bit which is "1" | Data bank | Order of contained higher harmonics | Frequency range ($H_z$) |
|---|---|---|---|
| $D_{18}$ | 7 | 1 | 12500–20000 |
| $D_{17}$ | 6 | 2 | 6250–12500 |
| $D_{16}$ | 5 | 4 | 3125–6250 |
| $D_{15}$ | 4 | 8 | 1562–3125 |
| $D_{14}$ | 3 | 16 | 781–1562 |
| $D_{13}$ | 2 | 32 | 390–781 |
| $D_{12}$ | 1 | 64 | 195–390 |
| $D_0$ to $D_{11}$ | 0 | 64 | –195 |

In the above table, the change over between the data bank 1 and 0 provides a difference in tone quality dependent upon the selected band.

Accordingly, the waveform data ROM 8 operates such that the waveform data in the predetermined data bank thereof is instantaneously read out with the outputs from the latch circuits 25 and 26 as the address signals, and in order to prevent a folded error if the higher harmonic components in the generated waveform become high, the data bank is changed over to a desired bank in accordance with the bank selecting signal from the priority encoder 9 and such folded error is avoided. As a result, the waveform data are read out from the selected data bank in the ROM 8 and then are provided to an output device through the latch circuit 10 at the timing shown in FIG. 6I.

The waveform data thus read out can be D-A converted and thereafter processed by means of aVCA (voltage controlled amplifier), EG (envelope generator) or the like, or applied to an all digitized electronic instrument.

As the waveform data previously stored in the ROM 8, in addition to a triangular waveform, a sawtooth waveform or other simple waveform, one periodic component of the sound of a musical instrument, which has been recorded and converted to digital form, may be used.

Further, pure sinusoidal data can be used as the waveform data and each progressively higher channelfrequency can be as a corresponding higher harmonic frequency, so that the present invention can be applied as a sound source apparatus in a sinusoidal wave synthesizing system. In this case, it is possible to give the generated sound a non-harmonic property and to provide independent envelopes for the higher harmonics to generate more natural and various tone colors.

In the above described embodiment the ROM 8 is used as the waveform data memory, but in place of the ROM, an RAM can be used and its content can be varied in time by a separate CPU (central processing unit) control or the like to provide a spectrum of sound that changes over a period of time.

Further, in the above embodiment, the respective banks of the waveform data are of equal size, but, in an alternative embodiment the memory banks that are limited in band can be smaller in accordance with a reduction in the number of data samples required for the bond-limited banks.

Also, if the operationspeed of the apparatus is increased, the number of channels of the waveform generating apparatus can be further increased. In such case, because the frequency set of the respective channels can be interfaced at a low speed, a circuit can be provided which will assign the frequency to a generator assignor in the waveform generating apparatus.

It will be apparent that many modifications and variations can be effected by one skilled in the art without departing from the spirit or scope of the present invention, which is to be determined by the appended claims.

I claim as my invention:

1. Digital waveform generating apparatus for generating a signal of a desired waveform at a selected frequency within a frequency range comprising generating means for generating a first data word whose digital value corresponds to said selected frequency;

accumulating means for storing a second data word corresponding to a data memory address;

adding means for adding the first data word to the second data word and storing the result in said accumulating means as an accumulated second data word;

waveform storage means for storing a plurality of waveform data words corresponding to said desired waveform, each of said waveform data words being stored at a predetermined respective data memory address therein;

clock means providing a timing signal of fixed frequency; and control means responsive to said timing signal for controlling said accumulating means and for addressing the waveform data words stored in said waveform storage means in accordance with the accumulated second data word stored in said accumulating means upon occurrence of said timing signal so that the addressed waveform data words are read out from said waveform storage means as said output signal;

wherein, to avoid a folded error in the output signal, said waveform storeage means is partitioned into a plurality of data banks each corresponding to a predetermined portion of said frequency range and each storing a corresponding plurality of waveform data words therein, with each such plurality of waveforms data words representing waveforms having progressively fewer harmonics as the frequency of the corresponding portion of the frequency range increases, and said control means includes means for selecting one of said data banks in accordance with the particular portion of the frequency range containing said selected frequency to provide as said output signal its waveform data words in response to said accumulated second data words.

2. Digital waveform generating apparatus according to claim 1, wherein said means for selecting one of said data banks includes latch means for latching the first data word, and priority encoder means coupled to said latch means for selecting the particular data bank of said waveform storage means corresponding to the portion of said frequency range containing the selected frequency on the basis of the bit position of the most significant digit contained in the latched first data word.

3. Digital waveform generating apparatus according to claim 1, wherein a pluraity of frequencies can be simultaneously selected; and wherein said generating means generates a plurality of said first data words respectively corresponding to said plurality of selected frequencies, said accumulating means has a plurality of storage locations respectively storing said first data words and associated second data words to be accumulated with the corresponding first data words; and said control means controls the accumulating of each of said second data words and addresses said waveform data words in a time-sharing fashion in accordance with each of the stored plurality of second data words.

4. Digital waveform generating apparatus according to claim 1, wherein said corresponding portions of the frequency range include portions arranged at octave intervals.

5. Digital waveform generating apparatus according to claim 4, wherein the maximum number of harmonics contained in the waveform data occur substantially as shown in the following table:

| MAXIMUM CONTAINED HARMONICS | FREQUENCY RANGE ($H_z$) |
|---|---|
| 1 | 12,500–20,000 |
| 2 | 6,250–12,500 |
| 4 | 3,125–6,250 |
| 8 | 1,562–3,125 |
| 16 | 781–1,562 |

* * * * *